US012172047B2

(12) United States Patent
Hsu

(10) Patent No.: US 12,172,047 B2
(45) Date of Patent: Dec. 24, 2024

(54) COMPOSITE EXERCISING MACHINE

(71) Applicant: Chih-Yung Hsu, Tainan (TW)

(72) Inventor: Chih-Yung Hsu, Tainan (TW)

( * ) Notice: Subject to any disclaimer, the term of this patent is extended or adjusted under 35 U.S.C. 154(b) by 254 days.

(21) Appl. No.: 17/987,970

(22) Filed: Nov. 16, 2022

(65) Prior Publication Data

US 2023/0381573 A1 Nov. 30, 2023

(30) Foreign Application Priority Data

May 24, 2022 (TW) ..... 111205386

(51) Int. Cl.

| | |
|---|---|
| ***A63B 21/00*** | (2006.01) |
| ***A63B 23/02*** | (2006.01) |
| ***A63B 23/035*** | (2006.01) |
| ***A63B 23/04*** | (2006.01) |

(52) U.S. Cl.

CPC ..... *A63B 21/4031* (2015.10); *A63B 21/154* (2013.01); *A63B 23/0211* (2013.01); *A63B 23/03508* (2013.01); *A63B 23/0494* (2013.01)

(58) Field of Classification Search

CPC ..... A63B 21/4031; A63B 21/154; A63B 23/0211; A63B 23/03508; A63B 23/0494; A63B 23/1209; A63B 23/1245; A63B 23/1281; A63B 2225/09; A63B 21/0051; A63B 21/0058; A63B 21/0088; A63B 21/012; A63B 21/0602; A63B 21/153; A63B 21/159; A63B 21/078; A63B 23/12

See application file for complete search history.

(56) References Cited

U.S. PATENT DOCUMENTS

| | | | | | |
|---|---|---|---|---|---|
| 4,077,626 | A * | 3/1978 | Newman | A63B 21/225 | 482/133 |
| 4,911,436 | A * | 3/1990 | Lighter | A63B 21/4047 | 482/138 |
| 4,949,958 | A * | 8/1990 | Richey | A63B 21/4029 | 482/96 |
| 5,058,888 | A * | 10/1991 | Walker | A63B 21/4047 | 482/142 |
| 5,195,937 | A * | 3/1993 | Engel | A63B 21/4043 | 482/133 |
| 5,302,161 | A * | 4/1994 | Loubert | A63B 21/157 | 482/99 |
| 5,354,251 | A * | 10/1994 | Sleamaker | A63B 21/4047 | 482/142 |

(Continued)

FOREIGN PATENT DOCUMENTS

| | | | | |
|---|---|---|---|---|
| TW | M612538 U | 6/2021 | | |
| TW | I745232 B | 11/2021 | | |
| WO | WO-2012036332 A1 * | 3/2012 | | A63B 21/0442 |

*Primary Examiner* — Sundhara M Ganesan

(74) *Attorney, Agent, or Firm* — Muncy, Geissler, Olds & Lowe, P.C.

(57) ABSTRACT

A composite exercising machine includes a base frame, a swinging unit, a pulling unit, a transmission unit, and a resistance unit. By applying a first operation force to the swinging unit, the pulling unit is linked through a connector to drive the transmission unit. Or, by applying a second operation force to the pulling unit to drive the transmission unit, a one-way wheel and a spindle are driven to rotate toward a first rotation direction, allowing retractors to accumulate a first restoring force. Accordingly, the composite exercising machine can be used selectively in various training modes.

10 Claims, 15 Drawing Sheets

(56) References Cited

U.S. PATENT DOCUMENTS

| | | | | |
|---|---|---|---|---|
| 9,433,815 | B1 * | 9/2016 | Hughes | A63B 15/00 |
| 10,786,701 | B1 * | 9/2020 | Ellis | A63B 23/03525 |
| 11,167,168 | B1 * | 11/2021 | Ellis | A63B 21/00076 |
| 11,745,040 | B1 * | 9/2023 | Krull | A63B 21/4035 482/118 |
| 2002/0077229 | A1 * | 6/2002 | McBride | A63B 23/035 482/130 |
| 2003/0032524 | A1 * | 2/2003 | Lamar | A63B 21/4029 482/8 |
| 2003/0199370 | A1 * | 10/2003 | Bucay-Bissu | A63B 21/4031 482/142 |
| 2003/0211920 | A1 * | 11/2003 | Mandel | A63B 21/015 482/115 |
| 2004/0002412 | A1 * | 1/2004 | Kuo | A63B 21/055 482/129 |
| 2006/0035772 | A1 * | 2/2006 | Golesh | A63B 21/4029 482/142 |
| 2010/0216600 | A1 * | 8/2010 | Noffsinger | A63B 23/12 482/5 |
| 2011/0269604 | A1 * | 11/2011 | Tseng | A63B 21/023 482/121 |
| 2014/0213414 | A1 * | 7/2014 | Balandis | A63B 21/169 482/111 |
| 2014/0274599 | A1 * | 9/2014 | Chuang | A63B 21/0557 482/115 |
| 2015/0352394 | A1 * | 12/2015 | Marti | A61B 5/1121 482/139 |
| 2016/0354638 | A1 * | 12/2016 | Carr | A63B 21/4043 |
| 2017/0189732 | A1 * | 7/2017 | Lee | A63B 21/06 |
| 2022/0072365 | A1 * | 3/2022 | Negrete | A61H 1/0292 |
| 2022/0161088 | A1 * | 5/2022 | Wilson | A63B 21/157 |
| 2023/0173331 | A1 * | 6/2023 | Wilson | A63B 21/00058 482/138 |

* cited by examiner

COMPOSITE EXERCISING MACHINE

BACKGROUND OF THE INVENTION

(a) Field of the Invention

The present invention relates to an exercising machine with various kinds of training modes.

(b) Description of the Prior Art

There are many kinds of exercising apparatuses on the market, and each one has its various training modes for users' choice.

For example, a Taiwanese utility patent M612538, "Easy-to-Fold Economical Sports Fitness Chair," published on Jun. 1, 2021, discloses a design for the convenience in and economy of exercising and training for waists and abdomens. The patent is a plate rack. A top of the plate rack is installed with a seating plate, and a front end of the seating plate is pivoted with a front support frame by bolts. When the front support frame pivots to an extension state and to a proper angle, there are through holes overlapped to a fixing pore of the plate rack, so that the front support frame can be locked with the plate rack by a securing pin. On the other, a rear end of the plate rack is pivoted with a rear support frame and is provided with a fixing pore, so that a safety securing pin can be inserted to stop and support the rear support frame, putting up the rear support frame at a proper angle or fixing the rear support frame when the rear support frame is pivoted to be parallelly attached to the plate rack. In addition, a front end of the rear support frame is also pivoted with a back rack, a top of the back rack is installed with a back cushion, and a middle section at a bottom of the back rack is pivoted with a support rack. The other end of the support rack can be latched into a latching slot on the rear support frame by a spacer to adjust the angle of back cushion, forming a chair that is put up for stretching, exercising and training the waist and abdomen. Furthermore, by using the securing pin to pivot the front support frame to an extension state and to fix the front support frame, stacking the back rack on the rear support frame, and pivoting and overlapping the back rack on the bottom of the plate rack for fixing, the size of storage and transportation is decreased.

However, this prior art can be only used to train a user's waist and abdomen and cannot train other parts of the user's body.

Moreover, a Taiwanese invention patent 1745232, "Weight Bearing Device of Workout Apparatus," published on Nov. 1, 2021, includes a case body, a drive device disposed in the case body, and a linking device disposed in the case body and linking with the drive device. The drive device has a drive motor capable of carrying out motions of a linking wheel and a stressed wheel of the linking device. A stressed belt circles around and connects with the stressed wheel. An end of the stressed belt is connected to a workout apparatus. Hence, a torque is generated when the drive motor is actuated. The stressed belt can generate a pulling force correspondingly through being carried by the linking wheel and the stressed wheel to thereby replace a loading force of a conventional weight block, adjust the required pulling force conveniently and quickly, increase the safety of use, decrease the noise caused during using, and reduce the overall volume.

This prior art has only a single training mode of weight bearing and cannot train other parts of the user's body either. Therefore, if one needs to carry out the training in various training modes, he or she will have to purchase other corresponding exercising machines, causing waste and taking up too much space to emplace the machines, which is not very perfect in use.

SUMMARY OF THE INVENTION

Accordingly, to solve the abovementioned shortcomings in the existing exercising machines, the present invention provides a composite exercising machine comprising a base frame, which is provided with a seat cushion and a back cushion, with a bottom of the base frame being provided respectively with a first mount and a second mount; a swinging unit, which is disposed on the base frame and includes a swinging piece, a first linking piece, two second linking pieces and a connector, with the swinging piece being pivoted to the base frame to swing relative to the base frame, an end of the first linking piece being connected to the swinging piece, the other end of the first linking piece being connected commonly to one end of the two linking pieces, and the other end of the second linking piece being fixed to the first mount; a pulling unit, which includes two pull handles and two third linking pieces, with an end of the third linking piece being connected to the pull handle; a transmission unit, which is disposed on the base frame and includes a spindle, two transmission wheels, a one-way wheel and two retractors, with the spindle being pivoted to the base frame, the two transmission wheels being fixed to the spindle, and the other end of the third linking piece winding the transmission wheel, so that the one-way wheel can drive the spindle toward a first rotation direction and rotate idly on the spindle toward a second rotation direction, and with the two retractors being connected to the spindle; a resistance unit, which is disposed on the base frame and is connected to the spindle, allowing the spindle to be equipped with a rotation resistance, so that when a first operation force is applied to the swinging unit, the pulling unit is linked by the connector to drive the transmission unit, or when a second operation force is applied to the pulling unit to drive the transmission unit, the one-way wheel and the spindle are driven to rotate toward the first rotation direction, and the retractors can accumulate a first restoring force, allowing the first restoring force to drive the one-way wheel to rotate idly on the spindle toward the second rotation direction, when the first operation force or the second operation force decreases or disappears.

Two ends of the abovementioned first mount are provided respectively with a securing portion, and the other end of the second linking piece is fixed to the securing portion.

The abovementioned connector is provided with two first pulleys and two second pulleys. The other end of the second linking piece goes around the first pulley and is fixed to the first mount, whereas the other end of the third linking piece goes around the second pulley and wraps around the transmission wheel.

Two ends of the abovementioned second mount are provided respectively with a first reverse wheel, a hollow rotating shaft and plural second reverse wheels. The two rotating shafts are combined with the second mount, the first reverse wheel is pivoted on the rotating shaft, and the first reverse wheel rotates relative to the second mount against the rotating shaft.

One end of the abovementioned third linking piece goes around the second reverse wheels, passes through the rotating shaft, goes around the first reverse wheel, and is connected to the pull handle.

A one-way bearing is disposed between the one-way wheel and the rotating shaft.

The retractor includes a casing and a volute spring. One end of the volute spring is fixed to the casing, and the other end of the volute spring is fixed to the rotating shaft. A sealing cap closes the casing.

The resistance unit includes a resistance connecting piece and a resistor. The resistor is fixed to the base frame, and the resistance connecting piece is connected to the one-way wheel and the resistor.

The resistor is a magnetic resistor, a friction force resistor, an air resistor, a liquid resistor, a motor or an electromagnetic braking resistor.

A rear of the back cushion is pivoted with a support bar, an upper side of the base frame is provided correspondingly with plural support recesses, and the support bar is selectively abutted on any one of the support recesses to support the back cushion, allowing the back cushion to be tilted up and raised by an angle.

The technical features are provided with following advantages:

1. The exercising machine can be used separately in a training mode for a waist and abdomen.
2. The exercising machine can be used separately in a training mode for legs.
3. The exercising machine can be used separately in a training mode for hands.
4. The exercising machine can be used separately in a training mode for hands, with a posture that a user lies down flat or sits up.
5. The exercising machine can be used separately in a training mode for a single hand.
6. By various kinds of training modes, those training modes can be used collectively in one exercising machine. Therefore, the size can be reduced without taking up space, and the operation mode can be diversified.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 11:
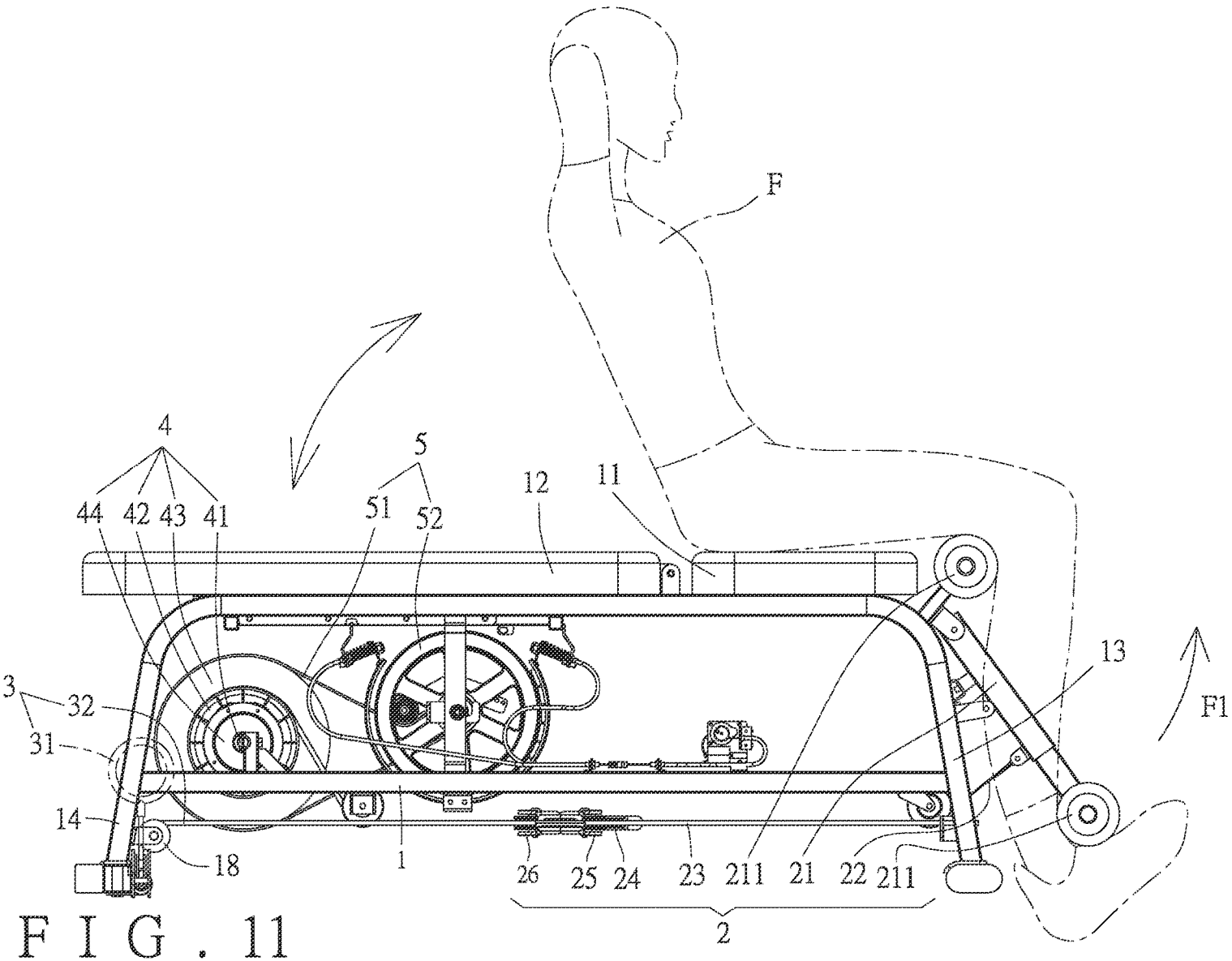
FIG. 11 shows a schematic view of use of the embodiment of the present invention, in a training mode for a waist and abdomen.

In the following embodiment, the terms of direction, such as left, right, front, rear, up, and down, are all the relative orientations that an operator F (as shown in FIG. 11) feels when he or she lies down flat or sits on a seat cushion 11 or back cushion 12 of a base frame 1 of the present invention. These terms of direction are only used as a convenient way to describe the present invention and are not meant to limit the spatial configurations of the present invention.

Referring to FIG. 1, FIG. 2, FIG. 3, and FIG. 4, the present embodiment comprises a base frame 1, a swinging unit 2, a pulling unit 3, a transmission unit 4 and a resistance unit 5.

Figure 5:
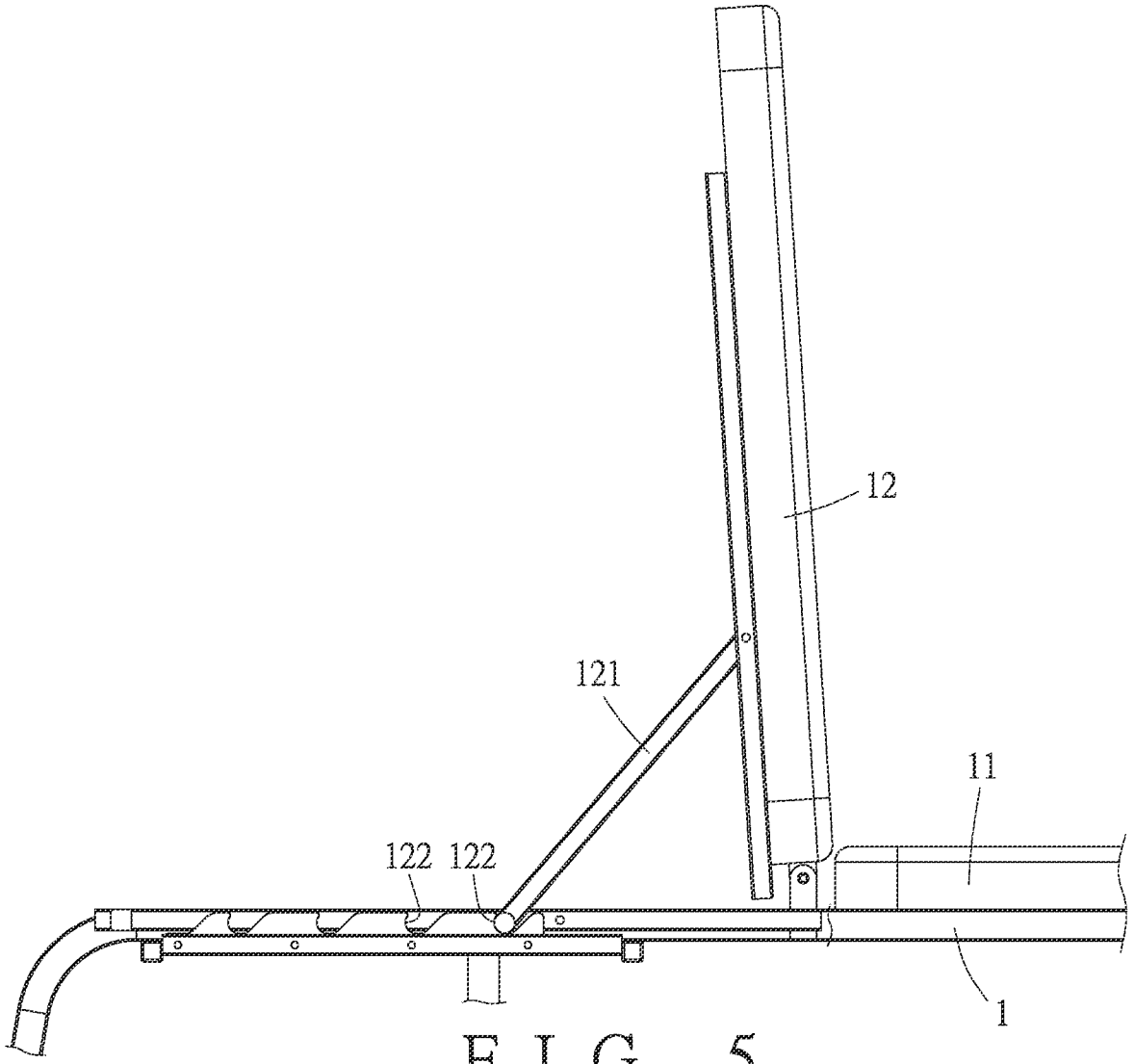
FIG. 5 is a schematic view of the embodiment of the present invention, showing that a back cushion is supported to be tilted up and raised.
Figure 6:
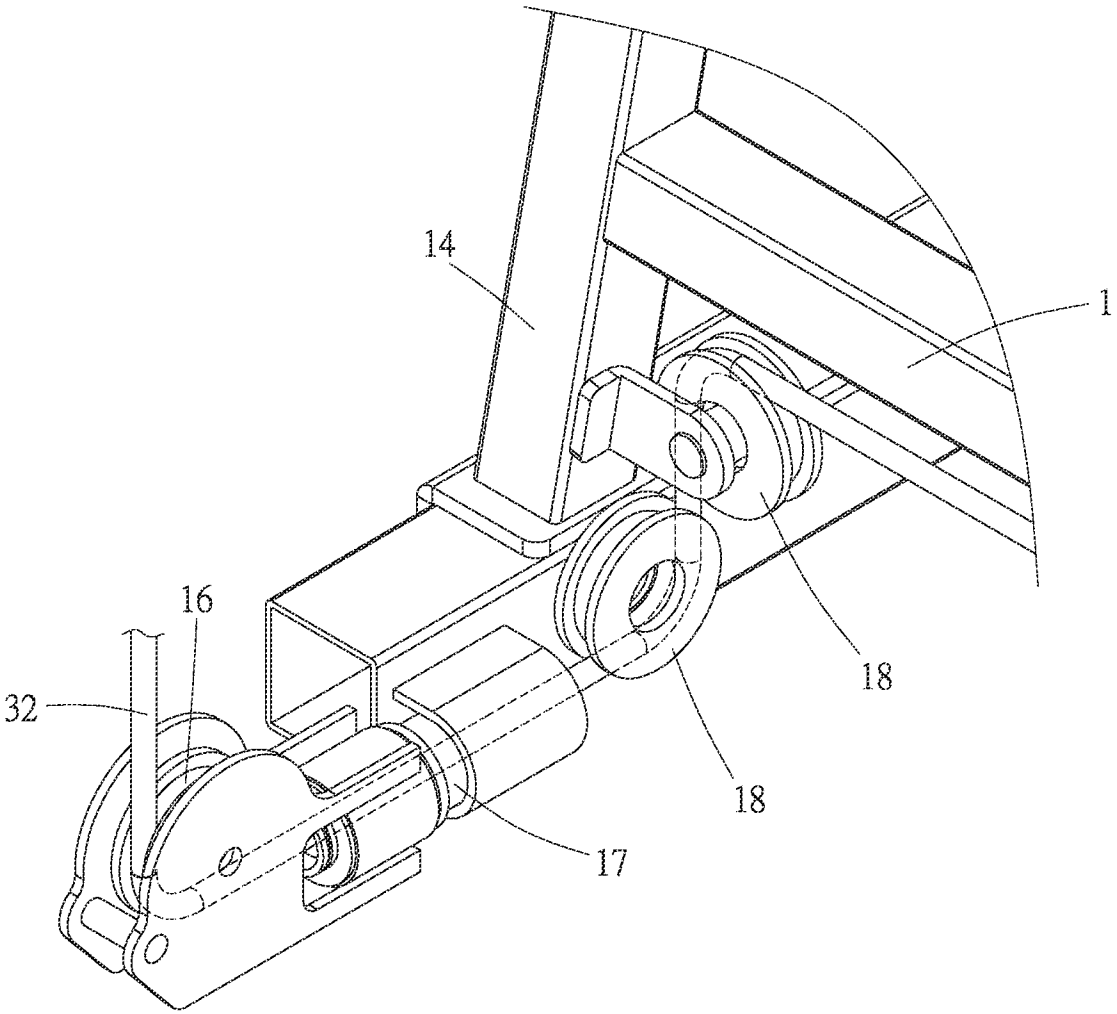
FIG. 6 shows a three-dimensional view of partial enlargement of a second mount, according to the embodiment of the present invention.

An upper side of the base frame 1 is provided with a seat cushion 11, and a back cushion 12 that can be tilted up and raised. The back cushion 12 can be raised and positioned in multiple stages. A front and rear of the base frame 1 are separated into a first mount 13 and a second mount 14 respectively, wherein two ends of the first mount 13 are provided respectively with a securing portion 15. As shown in FIG. 6, two ends of the second mount 14 are provided respectively with a first reverse wheel 16, a hollow rotating shaft 17, and plural second reverse wheels 18. The two rotating shafts 17 are combined to the second mount 14, the first reverse wheel 16 is pivoted on the rotating shaft 17, and the first reverse wheel 16 rotates relatively to the second mount 14 against the rotating shaft 17. As shown in FIG. 5, a rear of the back cushion 12 is pivoted with a support bar 121, and an upper side of the base frame 1 is provided correspondingly with plural support recesses 122, allowing the support bar 121 to be abutted on any one of the support recesses 122 selectively to support the back cushion 12, so that the back cushion 12 can be tilted up and raised by an angle.

Referring to FIG. 1, FIG. 2, FIG. 3, and FIG. 4, the swinging unit 2 is disposed on the base frame 1 and includes a swinging piece 21, a first linking piece 22, two second linking pieces 23, and a connector 24. The swinging piece 21 is pivoted on a top of the first mount 13 of the base frame 1 and can swing relative to the base frame 1. An upper and lower side of the swing piece 21 is provided with plural pressed wheels 211. An end of the first linking piece 22 is connected to the swinging piece 21, and the other end of the first linking piece 22 is connected commonly to one end of the two second linking pieces 23. The connector 24 is provided with two first pulleys 25 and two second pulleys 26. The other end of the second linking piece 23 goes around the first pulley 25, and is fixed to the securing portion 15 of the first mount 13.

The pulling unit 3 includes two pull handles 31 and two third linking pieces 32. An end of the third linking piece 32 goes around the two second reverse wheels 18, passes through the hollow rotating shaft 17, goes around the first reverse wheel 16, and is connected to the pull handle 31.

Figure 7:
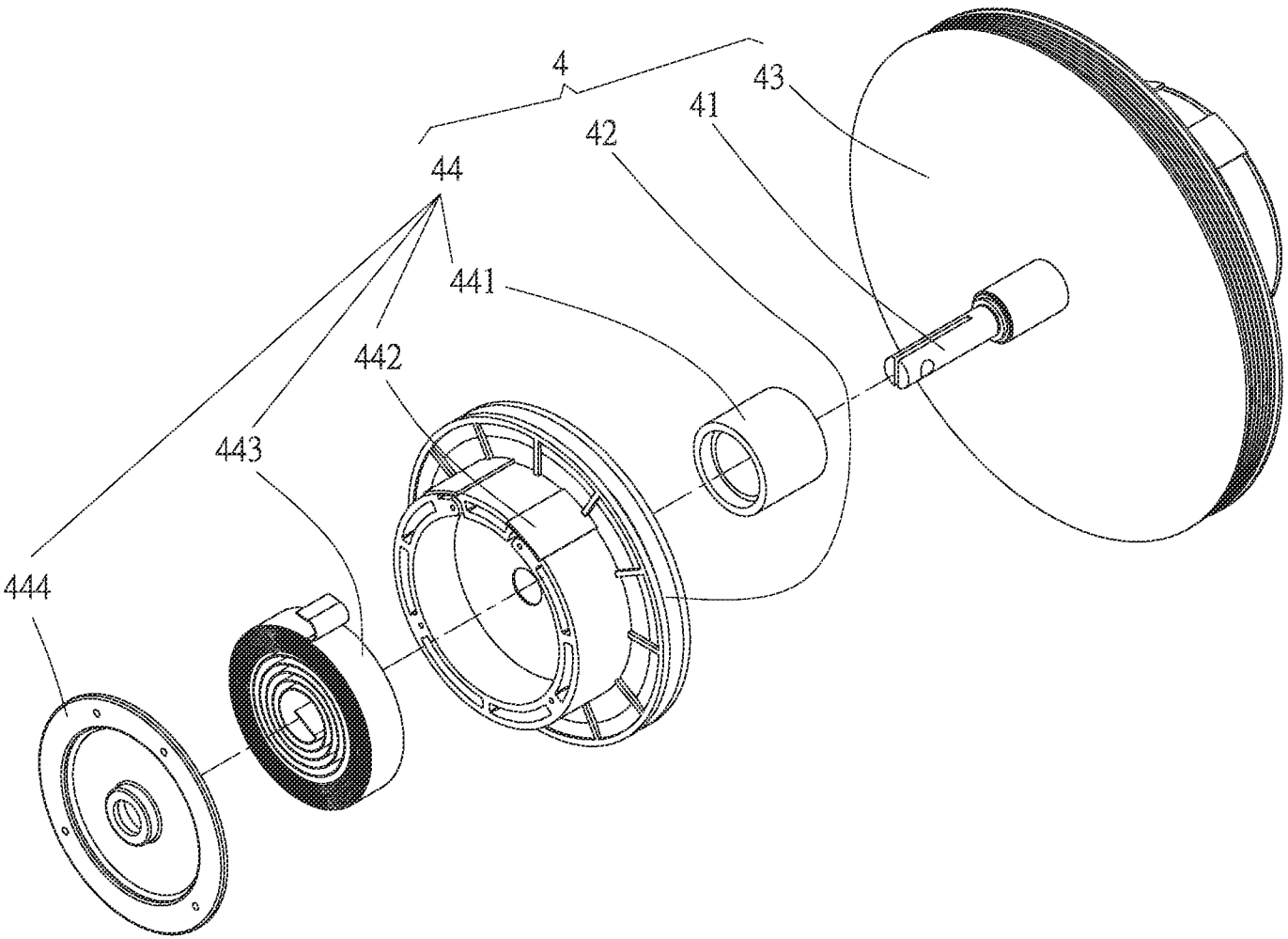
FIG. 7 shows a partially three-dimensional exploded view of a transmission unit, according to the embodiment of the present invention.
Figure 8:
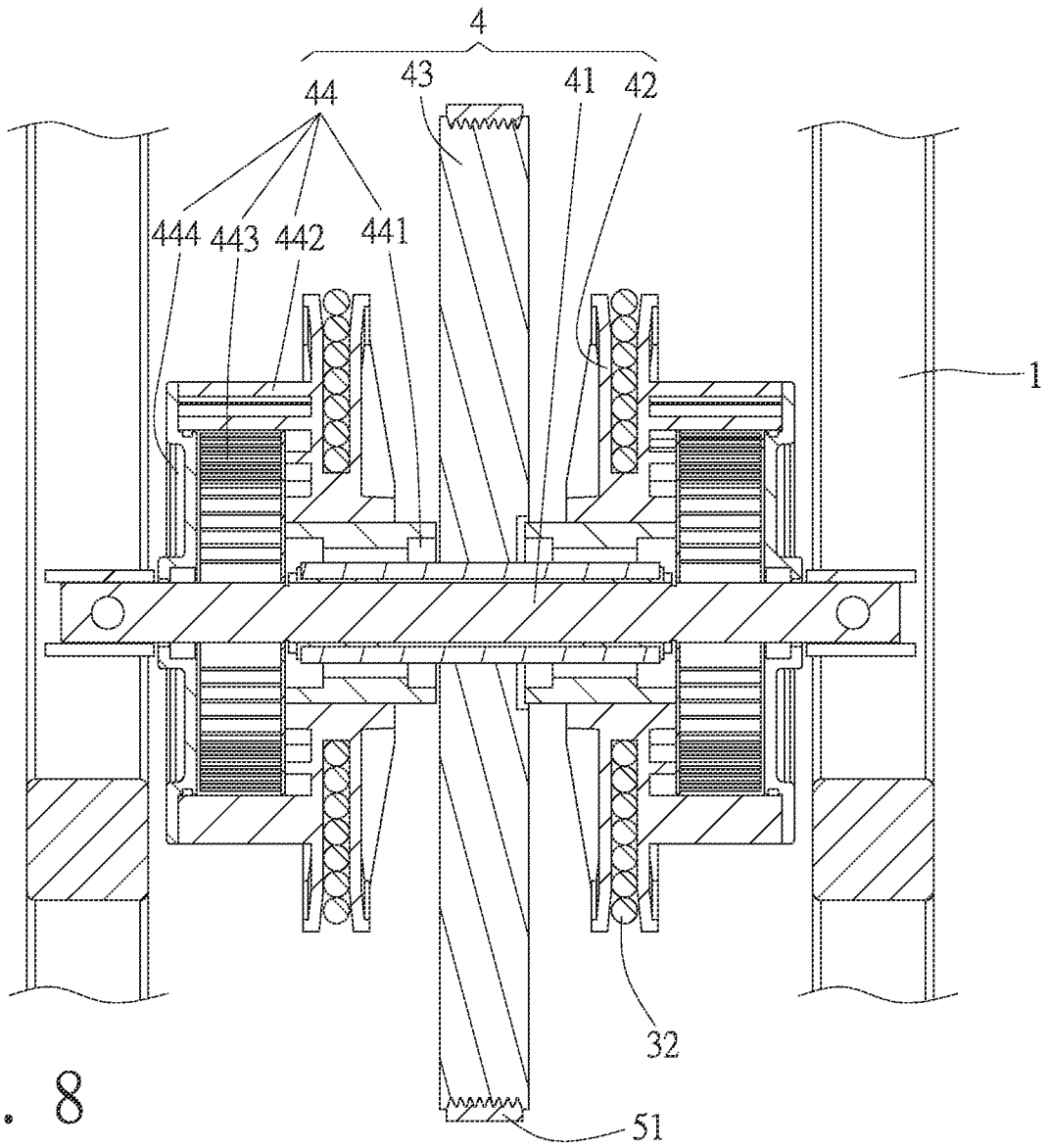
FIG. 8 shows a cutaway view along the line VIII-VIII in FIG. 2, according to the embodiment of the present invention.
Figure 9:
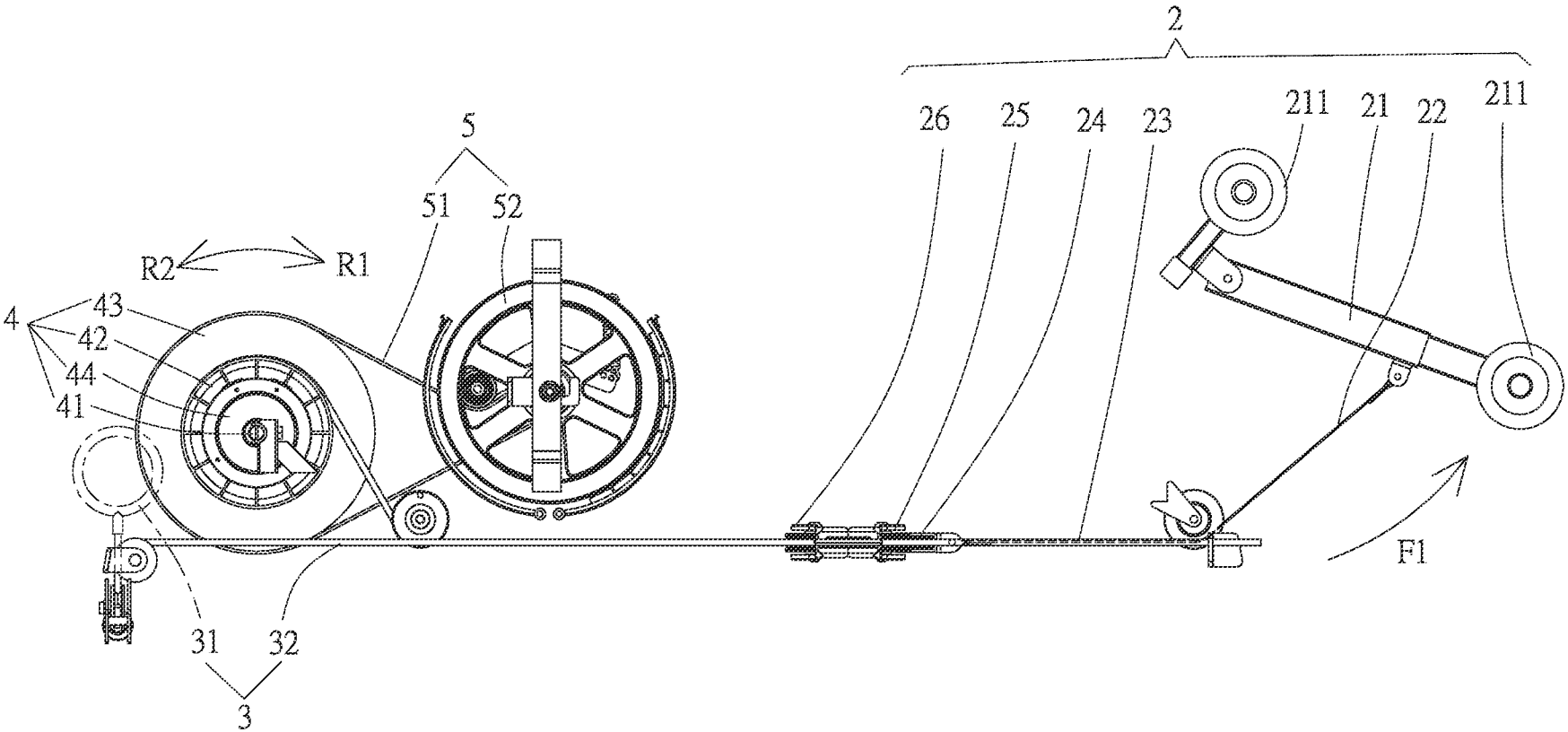
FIG. 9 is a schematic view of operation of the embodiment of the present invention, showing that a swinging piece swings upward to pull a first linking piece.
Figure 10:
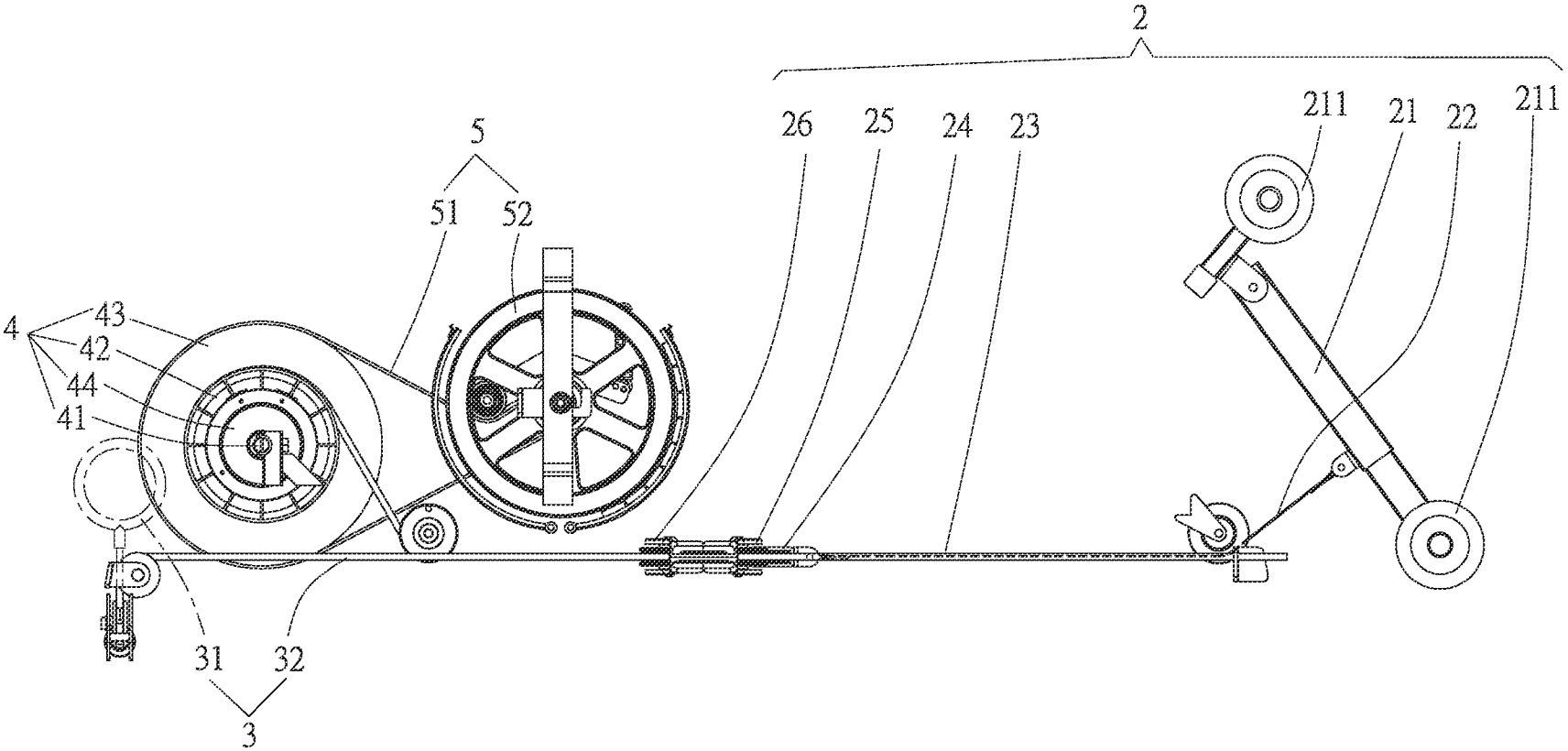
FIG. 10 is a schematic view of operation of the embodiment of the present invention, showing that the swinging piece swings downward to restore the first linking piece.

The transmission unit 4 is disposed on the base frame 1. As shown in FIG. 7, FIG. 8, and FIG. 9, the transmission unit 4 includes a spindle 41, two transmission wheels 42, a one-way wheel 43, and two retractors 44. The spindle 41 is pivoted to the base frame 1, and the two transmission wheels 42 are fixed to the spindle 41. The other end of the third linking pieces 32 goes around the second pulley 26 and wraps around the transmission wheel 42 for fixing. A one-way bearing 441 is disposed between the one-way wheel 43 and the spindle 41. By the one-way bearing 441, the one-way wheel 43 can drive the spindle 41 toward a first rotation direction R1, and rotate idly on the spindle 41 toward a second rotation direction R2; whereas, the first rotation direction R1 is opposite to the second rotation direction R2. The two retractors 44 are connected to the spindle 41, and the retractor 44 includes a casing 442 and a volute spring 443. An end of the volute spring 443 is fixed on an inner wall of the casing 442, the other end of the volute spring 443 is fixed to the spindle 41, and a sealing cap 444 closes the casing 442.

Figure 1:
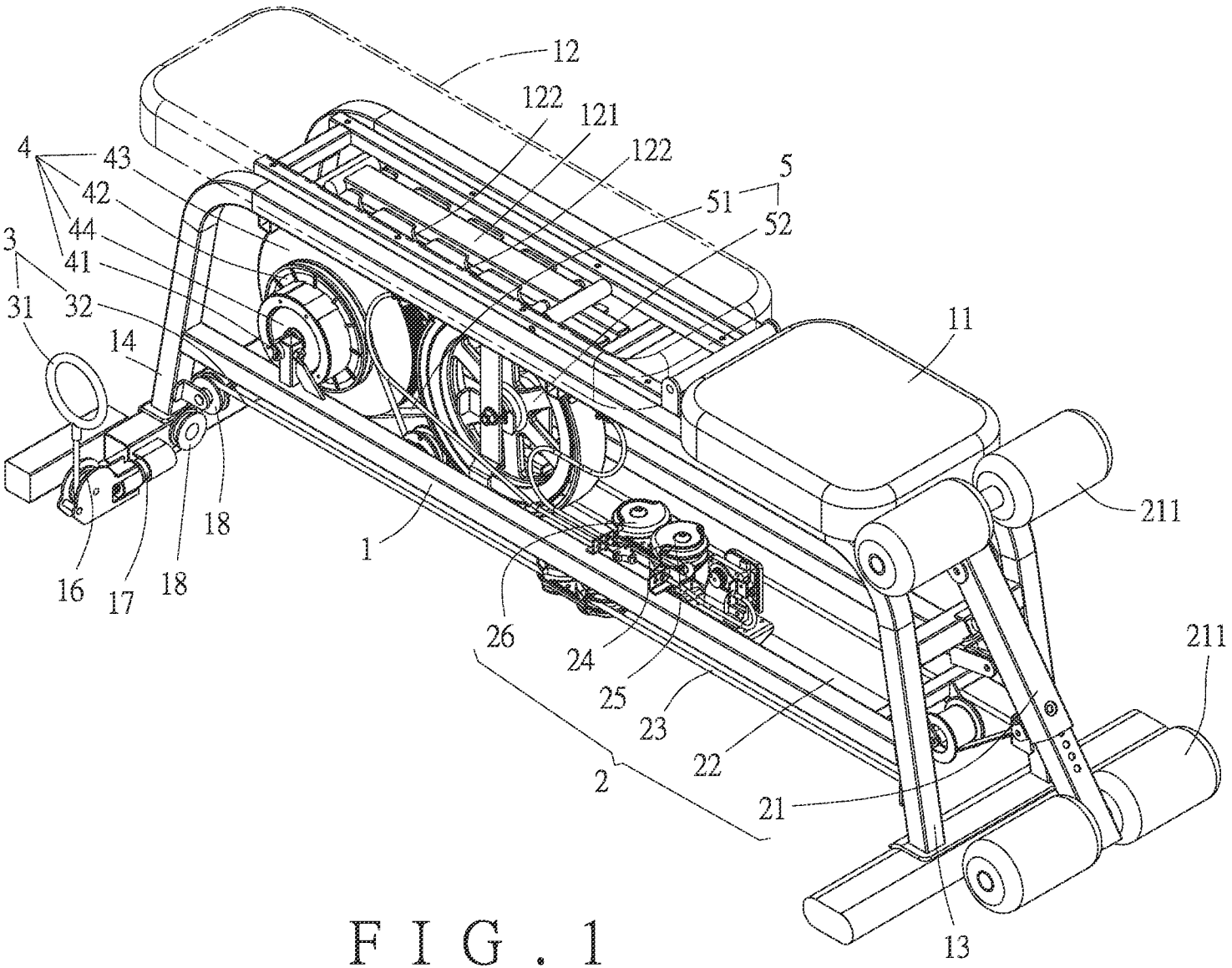
FIG. 1 shows a three-dimensional view of an embodiment of the present invention.
Figure 3:
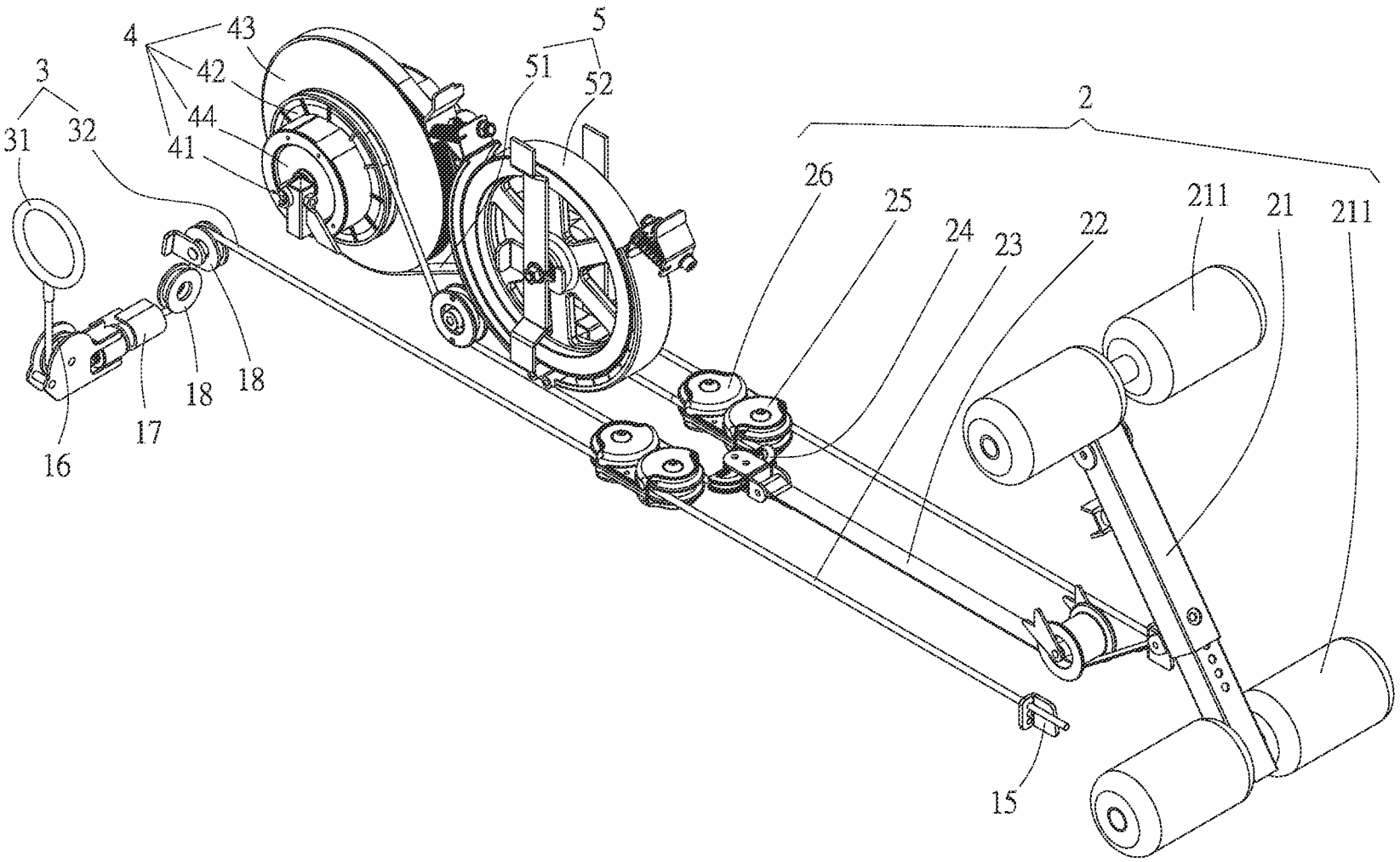
FIG. 3 shows a three-dimensional view of part of components, according to the embodiment of the present invention.
Figure 4:
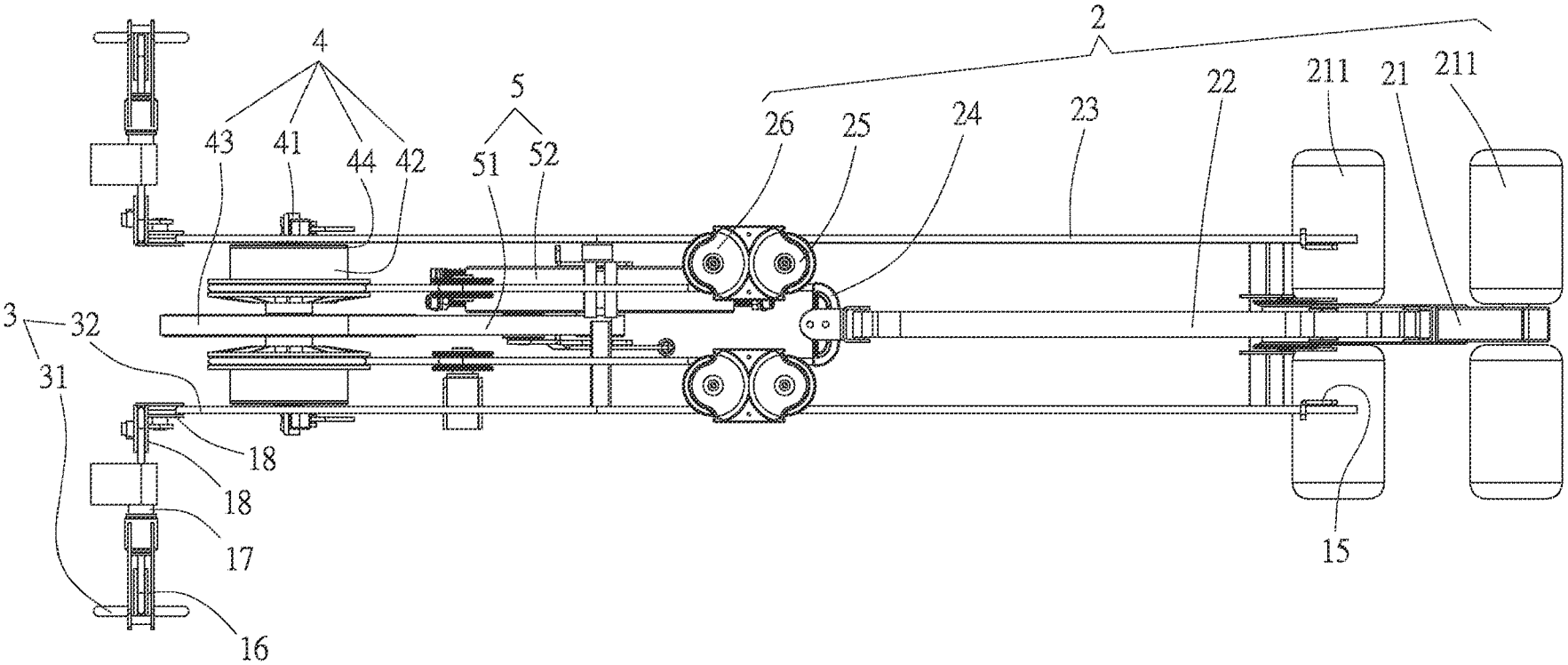
FIG. 4 shows a planar view of part of components, according to the embodiment of the present invention.

The resistance unit 5 is disposed on the base frame 1. As shown in FIG. 1, FIG. 3, and FIG. 4, the resistance unit 5 is connected to the spindle 41, allowing the spindle 41 to be equipped with a rotation resistance. The resistance unit 5 includes a resistance connecting piece 51 and a resistor 52. The resistor 52 is fixed to the base frame 1, whereas the resistance connecting piece 51 is connected to the one-way wheel 43 and the resistor 52. The resistor 52 is used to generate the rotation resistance and is a magnetic resistor, a friction force resistor, an air resistor, a liquid resistor, a motor or an electromagnetic braking resistor.

Referring to FIG. 8, FIG. 9, FIG. 11, and FIG. 13, by applying a first operation force F1 to the swinging piece 21 of the swinging unit 2, using to the first linking piece 22 and the two second linking pieces 23 to link the connector 24, using the connector 24 to link the two third linking pieces 32 of the pulling unit 3, and next using the two third linking pieces 32 to drive the two transmission wheels 42 of the transmission unit 4, the spindle 41 can be driven to rotate toward the first rotation direction R1. Or, by directly applying a second operation force F2 to the two third linking pieces 32 of the pulling unit 3, the two transmission wheels 42 can be also driven by the two third linking pieces 32 to drive the spindle 41 to rotate toward the first rotation direction R1. After the spindle 41 rotates toward the first rotation direction R1, by providing the one-way bearing 441 between the one-way wheel 43 and the spindle 41, the one-way bearing 441 can drive the one-way wheel 43 to rotate toward the first rotation direction R1. In the meantime, the two retractors 44 accumulate a first restoring force. When the first operation force F1 or the second operation force F2 decreases or disappears, by the one-way bearing 441, the first restoring force can drive the one-way wheel 43 to rotate idly on the spindle 41 toward the second rotation direction R2, thereby retracting the two third linking pieces 32.

Figure 2:
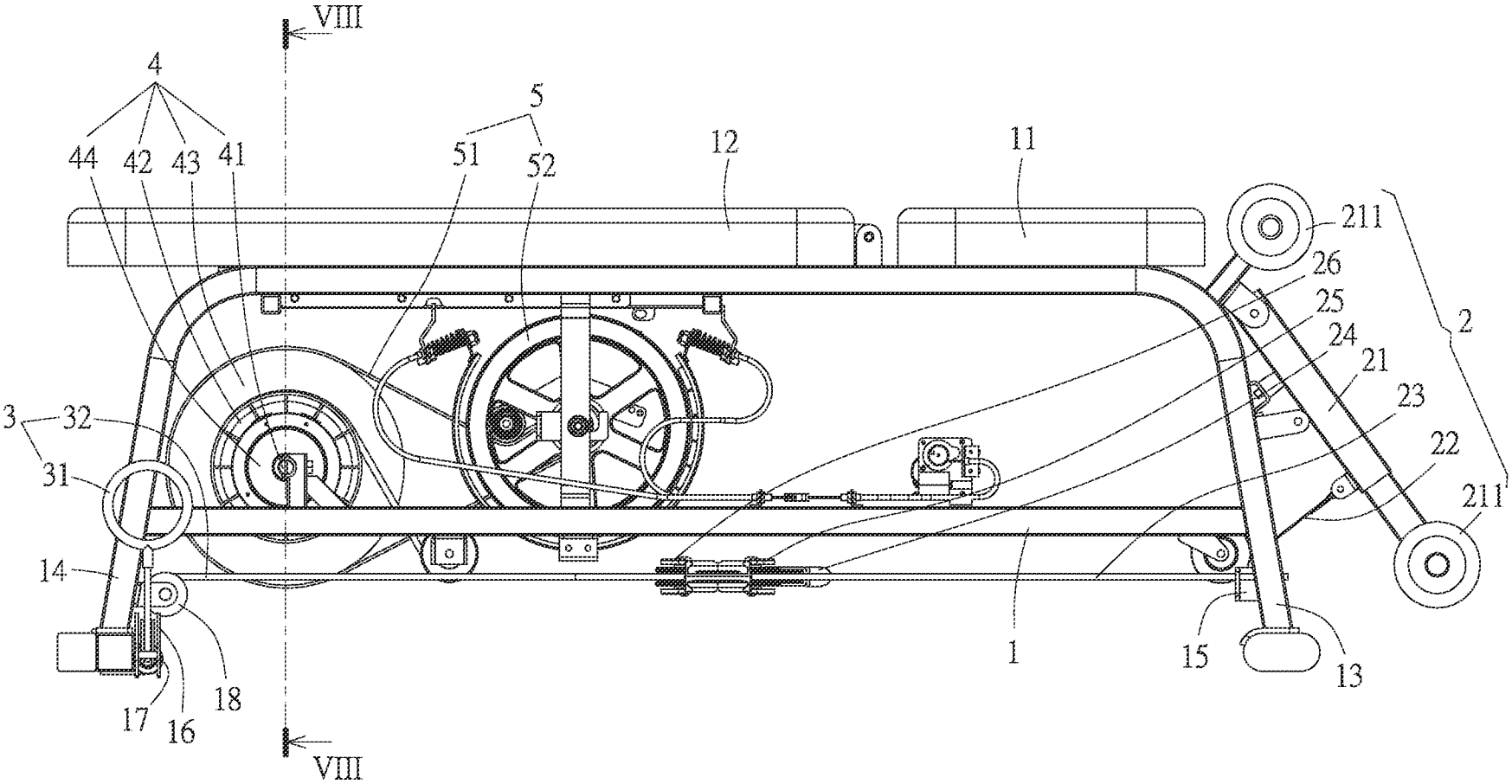
FIG. 2 shows a side view of the embodiment of the present invention.

When the present invention is used in a training mode for a sit-up exercise to the waist and abdomen, as shown in FIG. 1, FIG. 2, and FIG. 11, an operator F lies down flat on the seat cushion 11 and the back cushion 12 of the base frame 1, puts his or her legs on top rims of the pressed wheels 211 above the swinging piece 21, suspends his or her ankles downward and puts them on bottom rims of the pressed wheels 211 below the swinging piece 21, and then uses the swinging piece 21 as a pivot. Hence, the operator F can stick out his or her upper body hard to swing, in order to proceed a training to the waist and abdomen.

Figure 12:
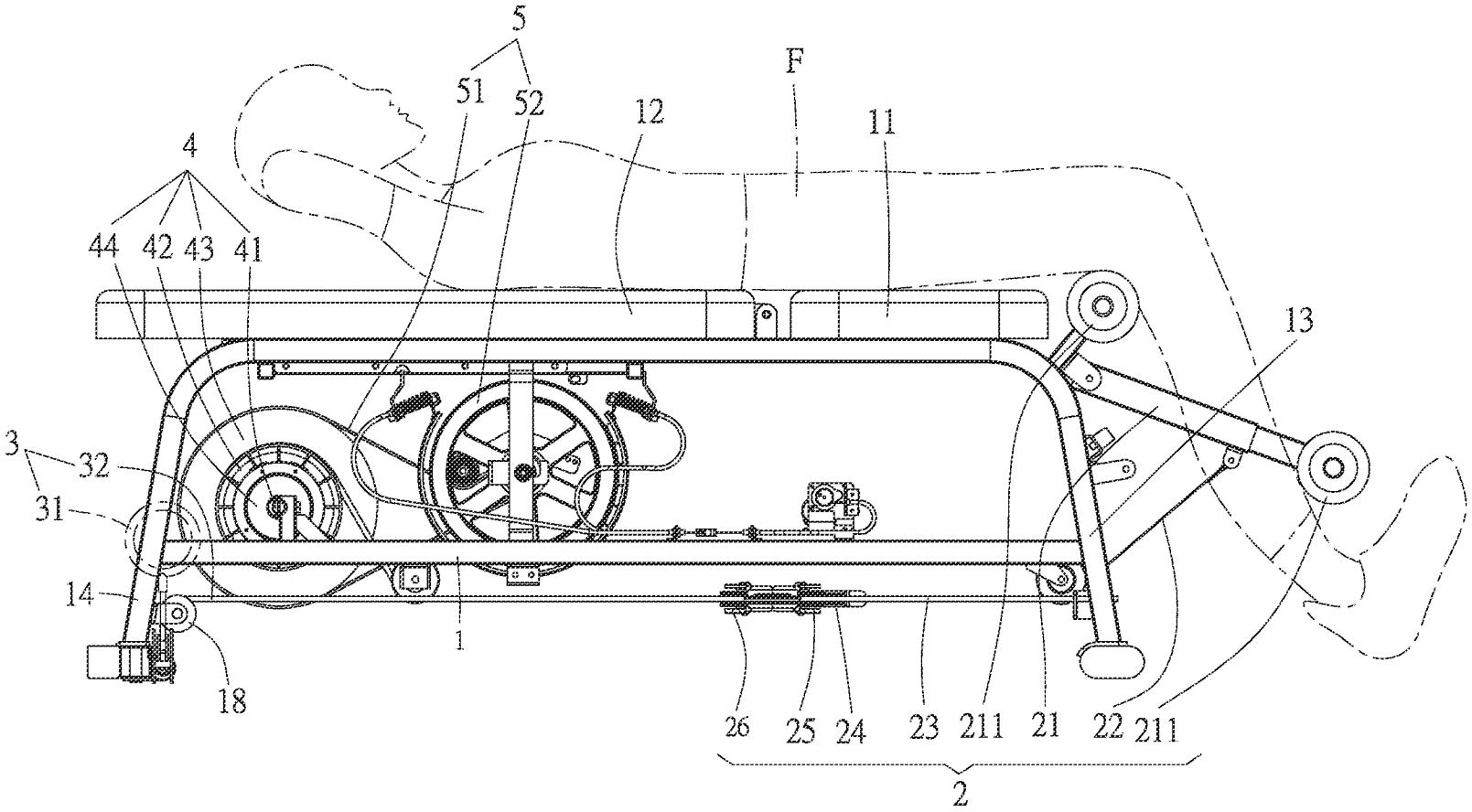
FIG. 12 shows a schematic view of use of the embodiment of the present invention, in a training mode for legs.

When the present invention is used in a training mode for legs, as shown in FIG. 1, FIG. 9, and FIG. 12, the operator F lies down flat on the seat cushion 11 and the back cushion 12 of the base frame 1, puts his or her legs on the top rims of the pressed wheels 211 above the swinging piece 21, suspends his or her ankles downward and puts them on the bottom rims of the pressed wheels 211 below the swinging piece 21, and then uses the legs to stick upward the pressed wheels 211 below the swinging piece 21, so that by applying a first operation force F1 to the swinging piece 21, the swinging piece 21 can swing upward relative to the base frame 1. When the swinging piece 21 swings upward, the first operation force F1 can pull the two second linking pieces 23 orderly through the first linking piece 22, and the two second linking pieces 23 can transmit the force on the two first pulleys 25 to link directly the connector 24 to move, allowing the connector 24 to move toward the first mount 13. Next, by that the second pulleys 26 on the connector 24 link the two third linking pieces 32, the two third linking pieces 32 can be pulled.

Referring to FIG. 6, FIG. 7, FIG. 8, and FIG. 9, next, by that the two third linking pieces 32 drive the two transmission wheels 42 of the transmission unit 4 to rotate toward the first rotation direction R1, the spindle 41 will be driven to rotate toward the first rotation direction R1. After the spindle 41 rotates toward the first rotation direction R1, by the one-way bearing 441, the spindle 41 can drive the one-way wheel 43 to rotate toward the first rotation direction R1 and rotate the two volute springs 443 at a same time. Therefore, the two volute springs 443 will accumulate a first restoring force. By the resistance connecting piece 51, the one-way wheel 43 links the resistor 52 to rotate, allowing the spindle 41 to be equipped with a rotation resistance. The rotation resistance can be transmitted to the swing piece 21 through the transmission unit 4, thereby training the legs of the operator F.

Referring to FIG. 6, FIG. 8, FIG. 9, and FIG. 10, when the legs of the operator F do not apply forces anymore, the swinging piece 21 swings downward relative to the base frame 1. When the first operation force F1 decreases or disappears, by the one-way bearing 441, the two volute springs 443 will use the first restoring force to drive the spindle 41 to rotate reversely toward the second rotation direction R2. By the one-way bearing 441, the one-way wheel 43 is driven to rotate idly on the spindle 41 toward the second rotation direction R2, so that the two third linking pieces 32 can be retracted, the connector 24 can be pulled to move toward the second mount 14, and the connector 24 can link the two second linking pieces 23 and the first linking piece 22 to restore to their original locations. By raising the legs to apply forces back and forth, the swinging piece 21 can swing upward and downward, thereby implementing the training mode for legs.

Figure 13:
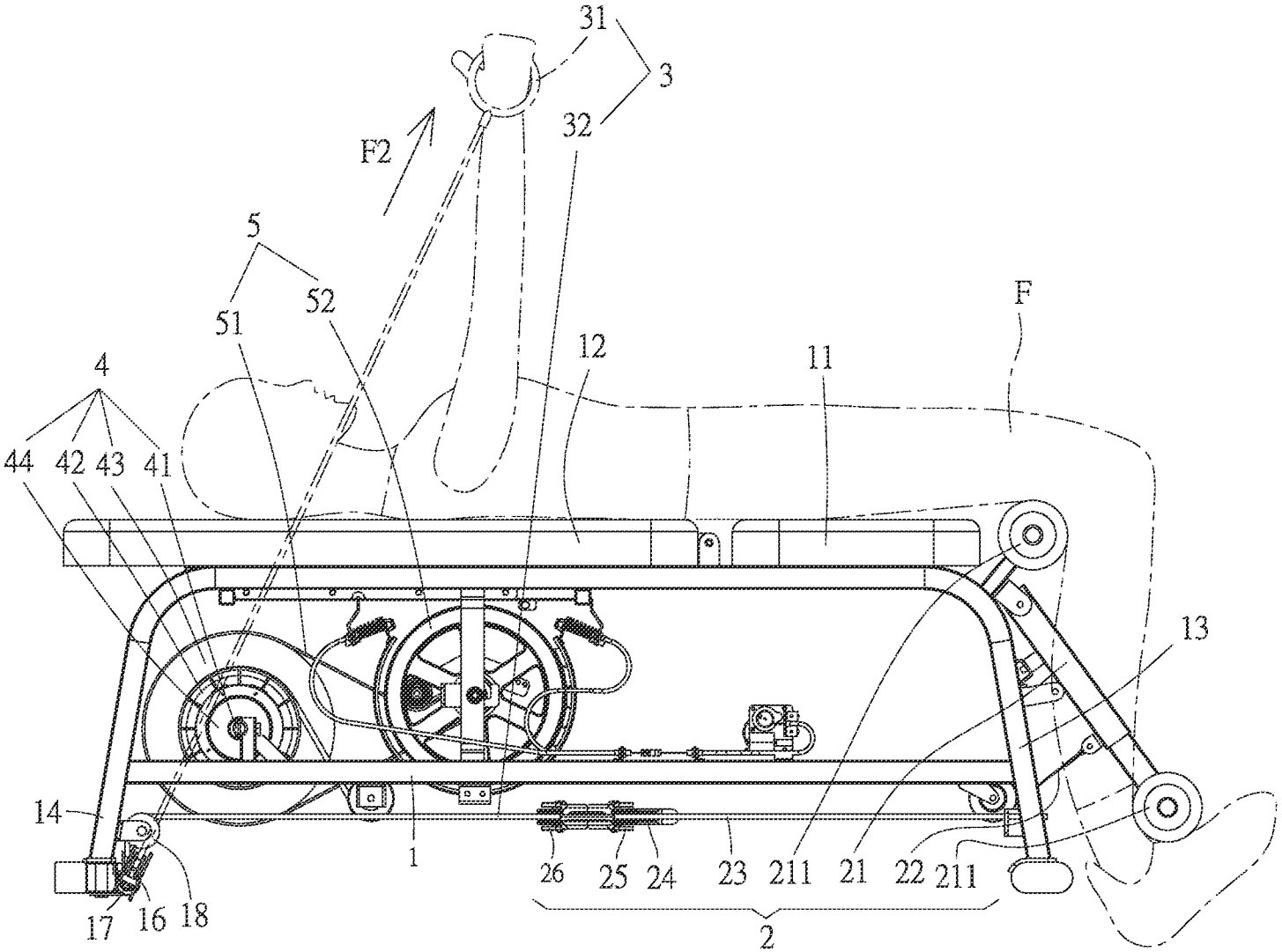
FIG. 13 shows a schematic view of use of the embodiment of the present invention, in a training mode for hands when a user lies down flat.
Figure 14:
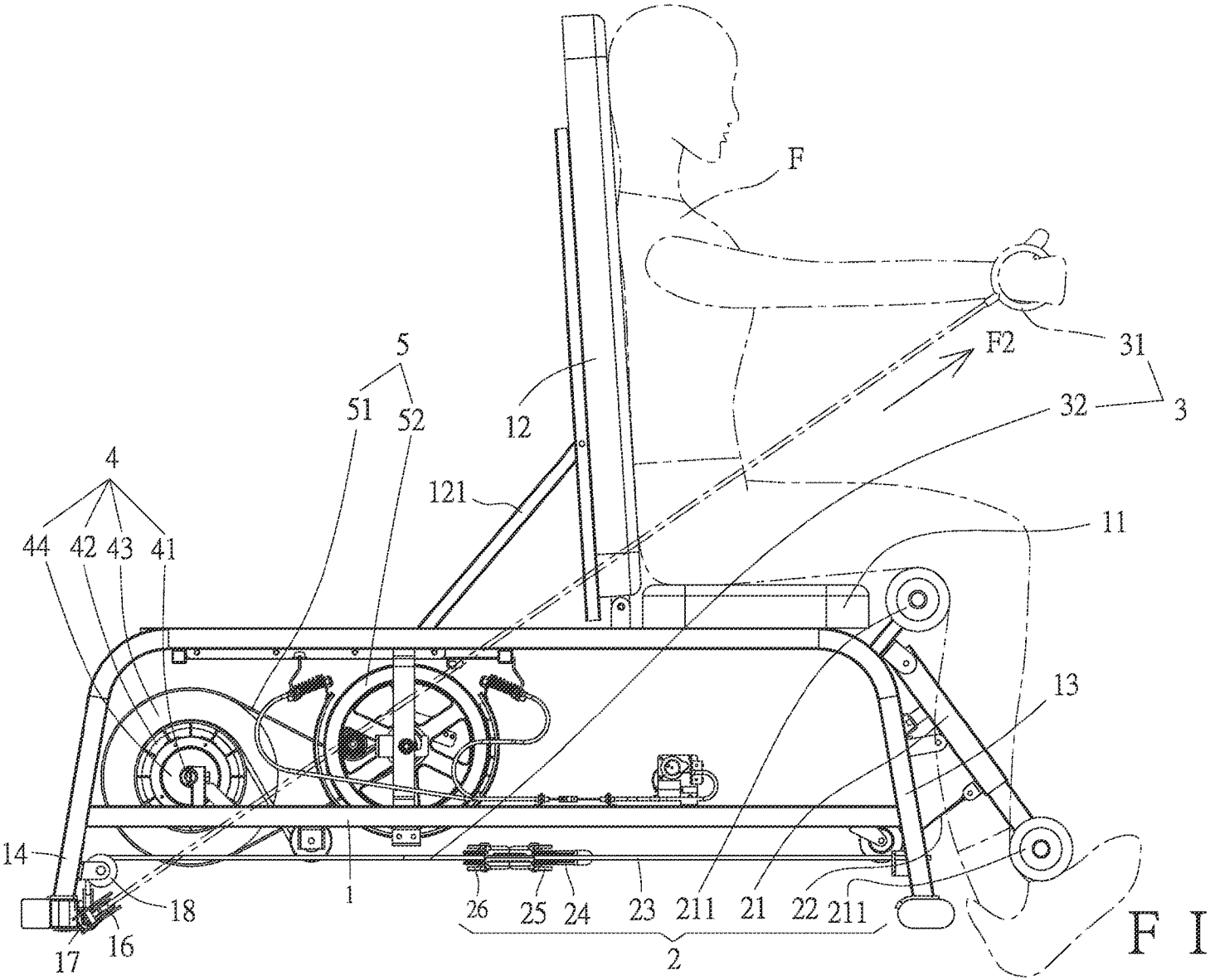
FIG. 14 shows a schematic view of use of the embodiment of the present invention, in a training mode for hands when the user sits up.

When the present invention is used in a training mode for hands, as shown in FIG. 1, FIG. 9, and FIG. 13, the operator F lies down flat on the seat cushion 11 and the back cushion 12 of the base frame 1, holds on the two pull handles 31 of the pulling unit 3 with both hands, and applies forces to pull up the two pull handles 31. By applying the second operation force F2 to the two third linking pieces 32, the two third linking pieces 32 can be pulled.

Referring to FIG. 6, FIG. 7, FIG. 8, and FIG. 9, next, by that the two third linking pieces 32 drive the two transmission wheels 42 of the transmission unit 4 to rotate toward the first rotation direction R1, the spindle 41 is driven to rotate toward the first rotation direction R1. After the spindle 41 rotates toward the first rotation direction R1, by the on-way bearing 441, the spindle 41 can drive the one-way wheel 43 to rotate toward the first rotation direction R1 and rotate the two volute springs 443 at a same time. Therefore, the two volute springs 443 will accumulate the first restoring force. The one-way wheel 43 links the resistor 52 to rotate through the resistance connecting piece 51, allowing the spindle 41 to be equipped with the rotation resistance. The rotation resistance can be transmitted to the two pull handles 31 through the transmission unit 4, thereby training the hands of the operator F.

Referring to FIG. 6, FIG. 8, FIG. 9, and FIG. 11, when the hands of the operator F do not apply forces anymore, the two pull handles 31 are put down. When the second operation force F2 decreases or disappears, by the one-way bearing 441, the two volute springs 443 will use the first restoring force to drive the spindle 41 to rotate reversely toward the second rotation direction R2. By the one-way bearing 441, the one-way wheel 43 is driven to rotate idly on the spindle 41 toward the second rotation direction R2, so that the two third linking pieces 32 can be retracted, and the two pull handles 31 can be restored to their original locations. By applying forces with hands back and forth, the two pull handles 31 can be pulled upward and downward to implement the training mode for hands.

Referring to FIG. 1, FIG. 5, FIG. 9, and FIG. 14, the present invention can also provide the operator F to sit up directly on the seat cushion 11 of the base frame 1, and to tilt up and raise the back cushion 12 at a proper height. After that, the support bar 121 at the rear of the back cushion 12 is selectively abutted on the corresponding support recess 122, to support the back cushion 12, so that the back cushion 12 can be tilted up and raised by an angle, acting as a training mode for hands to implement the training for hands as well.

Figure 15:
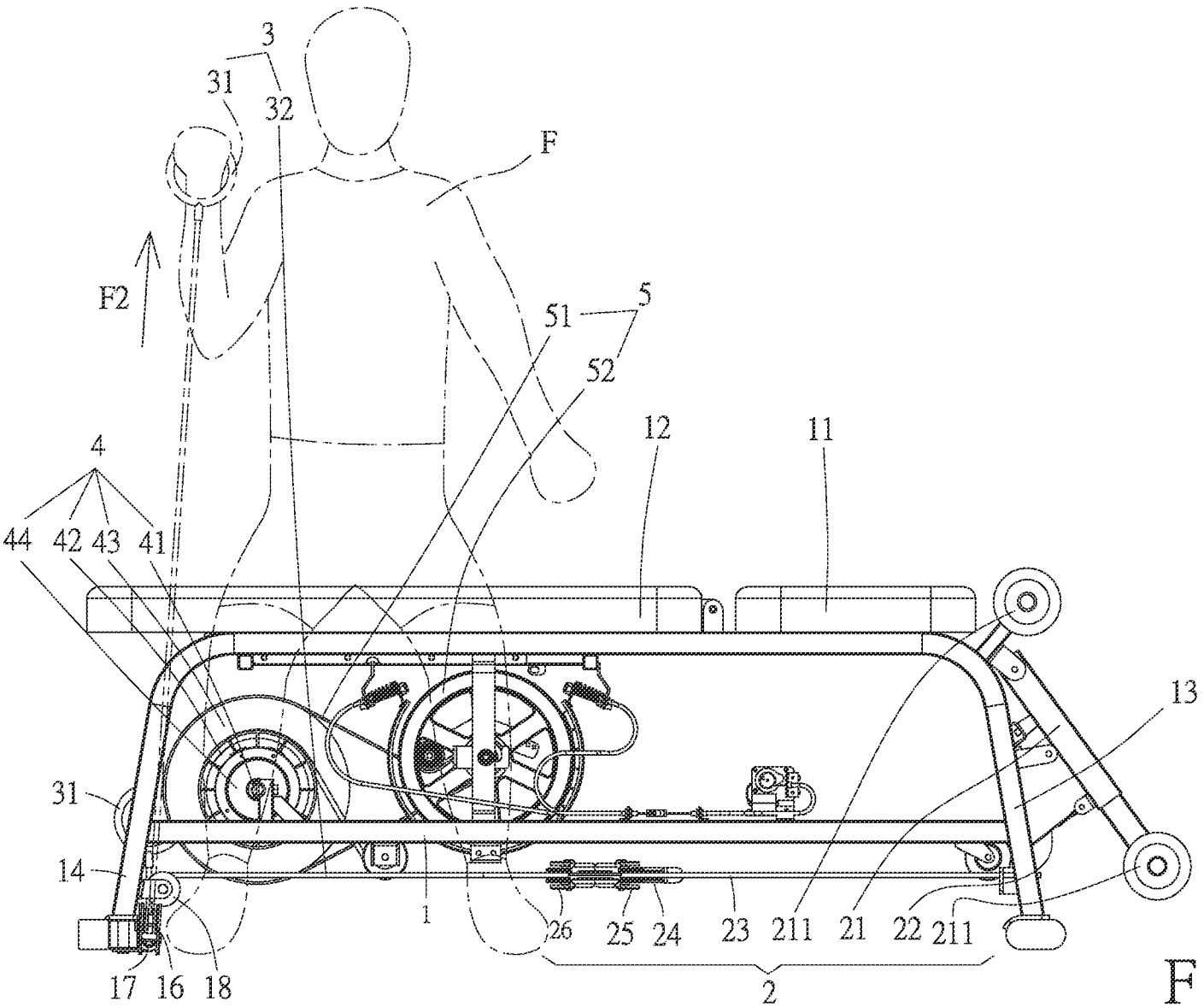
FIG. 15 shows a schematic view of use of the embodiment of the present invention, in a training mode for a single hand.

Referring to FIG. 1, FIG. 9, and FIG. 15, in addition to that the present invention can be used in the training mode for hands, the operator F can sit sideways on the seat cushion 11 or the back cushion 12 of the base frame 1 directly, acting as a training mode for a single hand. The single-hand operation mode and operation method are the same as that of the two-hand training mode; therefore, no further description is provided, and the effect of single-hand training can be achieved too.

It is of course to be understood that the embodiments described to herein is merely illustrative of the principles of the invention and that a wide variety of modifications thereto may be effected by persons skilled in the art without departing from the spirit and scope of the invention as set forth in the following claims.

What is claimed is:

1. A composite exercising machine, comprising:

a base frame, which is provided with a seat cushion and a back cushion, with a bottom of the base frame being provided respectively with a first mount and a second mount;

a swinging unit, which is disposed on the base frame, wherein, the swinging unit is provided with a swinging piece, a first linking piece, two second linking pieces, and a connector, with the swinging piece being pivoted to the base frame and swinging relative to the base frame, an end of the first linking piece being connected to the swinging piece, the other end of the first linking piece being connected jointly to an end of the two second linking pieces, and the other end of the second linking piece being fixed to the first mount;

a pulling unit, which is provided with two pull handles and two third linking pieces, with an end of the third linking piece being connected to the pull handle;

a transmission unit, which is disposed on the base frame, wherein, the transmission unit is provided with a spindle, two transmission wheels, a one-way wheel, and two retractors, with the spindle being pivoted to the base frame, the two transmission wheels being fixed to the spindle, the other end of the third linking piece wrapping around the two transmission wheels thereby allowing the one-way wheel to drive the spindle toward a first rotation direction and to rotate idly on the spindle toward a second rotation direction, and the two retractors being connected to the spindle; and a resistance unit, which is disposed on the base frame, wherein, the resistance unit is connected to the spindle, thereby allowing the spindle to be equipped with a rotation resistance;

wherein, by applying a first operation force to the swinging unit, the pulling unit is linked by the connector to drive the transmission unit, or by applying a second operation force to the pulling unit to drive the transmission unit, the one-way wheel and the spindle are driven to rotate toward the first rotation direction, and the two retractors accumulate a first restoring force at a same time; when the first operation force or the second operation force decreases or disappears, the first restoring force drives the one-way wheel to rotate idly on the spindle toward the second rotation direction.

2. The composite exercising machine according to claim 1, wherein two ends of the first mount are provided respectively with a securing portion, and the other end of the second linking piece is fixed to the securing portion.

3. The composite exercising machine according to claim 1, wherein the connector is provided with two first pulleys and two second pulleys, the other end of the second linking piece goes around the first pulley and is fixed to the first mount, and the other end of the third linking piece goes around the second pulley and wraps around the two transmission wheels.

4. The composite exercising machine according to claim 1, wherein two ends of the second mount are provided respectively with a first reverse wheel, a hollow rotating shaft, and plural second reverse wheels, the two rotating shafts are combined to the second mount, the first reverse wheel is pivoted to the rotating shaft, and the first reverse wheel rotates relative to the second mount against the rotating shaft.

5. The composite exercising machine according to claim 4, wherein an end of the third linking piece wraps around the second reverse wheels, passes through the rotating shaft, wraps around the first reverse wheel, and is connected to the pull handle.

6. The composite exercising according to claim 1, wherein a one-way bearing is disposed between the one-way wheel and the spindle.

7. The composite exercising machine according to claim 1, wherein the retractor includes a casing and a volute spring, an end of the volute spring is fixed to the casing, the other end of the volute spring is fixed to the spindle, and the casing is closed by a sealing cap.

8. The composite exercising machine according to claim 1, wherein the resistance unit comprises a resistance connecting piece and a resistor, the resistor is fixed to the base frame, and the resistance connecting piece is connected to the one-way wheel and the resistor.

9. The composite exercising machine according to claim 8, wherein the resistor is a magnetic resistor, a friction force resistor, an air resistor, a liquid resistor, a motor or an electromagnetic braking resistor.

10. The composite exercising machine according to claim 1, wherein a rear of the back cushion is pivoted with a support bar, an upper side of the base frame is provided correspondingly with plural support recesses, and the support bar is selectively abutted on any one of the support recesses to support the back cushion, thereby allowing the back cushion to be tilted up and raised by an angle.

* * * * *